United States Patent [19]

Shimizu et al.

[11] 4,419,712

[45] Dec. 6, 1983

[54] ELECTRONIC DOOR LOCKING SYSTEM FOR AN AUTOMOTIVE VEHICLE

[75] Inventors: Keiichi Shimizu, Tokyo; Haruo Mochida, Yokohama, both of Japan

[73] Assignees: Nissan Motor Company, Limited, Kanagawa; Kokusan Kinzoku Kogyo Co., Ltd., Tokyo, both of Japan

[21] Appl. No.: 373,286

[22] Filed: Apr. 29, 1982

[30] Foreign Application Priority Data

Apr. 30, 1981 [JP] Japan ..... 56-66013

[51] Int. Cl.[3] ..... E05B 49/00

[52] U.S. Cl. ..... 361/172; 70/262; 180/287; 307/10 AT

[58] Field of Search ..... 361/172; 307/10 AT; 180/287, 289; 70/262

[56] References Cited

U.S. PATENT DOCUMENTS

| | | | |
|---|---|---|---|
| 3,399,554 | 9/1968 | Hogue | 70/262 |
| 3,633,167 | 1/1972 | Hedin | 361/172 X |
| 3,691,396 | 9/1972 | Hinrichs | 307/40 |
| 3,764,859 | 10/1973 | Wood | 317/134 |
| 3,831,065 | 8/1974 | Martin et al. | 361/172 |
| 4,189,712 | 2/1980 | Lemelson | 340/149 A |
| 4,240,516 | 12/1980 | Henderson et al. | 180/289 |

FOREIGN PATENT DOCUMENTS 2913955 of 0000 Fed. Rep. of Germany .

*Primary Examiner*—Harry E. Moose, Jr.

*Attorney, Agent, or Firm*—Lowe, King, Price & Becker

[57] ABSTRACT

An electronic door locking system for an automotive vehicle with which vehicle doors can be locked, by depressing a proper push-button type switch representative of a predetermined door-locking digit, only when an ignition key is brought near the switch. Therefore, it is possible to lock vehicle doors without leaving the ignition key in the keyhole, with the result that the vehicle can be prevented from being stolen by a thief when parked. The electronic door locking system according to present invention comprises means for detecting the presence of the ignition key brought near the switch and an AND gate for passing a locking command signal to a door lock/unlock actuating solenoid only when the presence of the key is detected, in addition to the conventional electronic door locking system.

7 Claims, 1 Drawing Figure

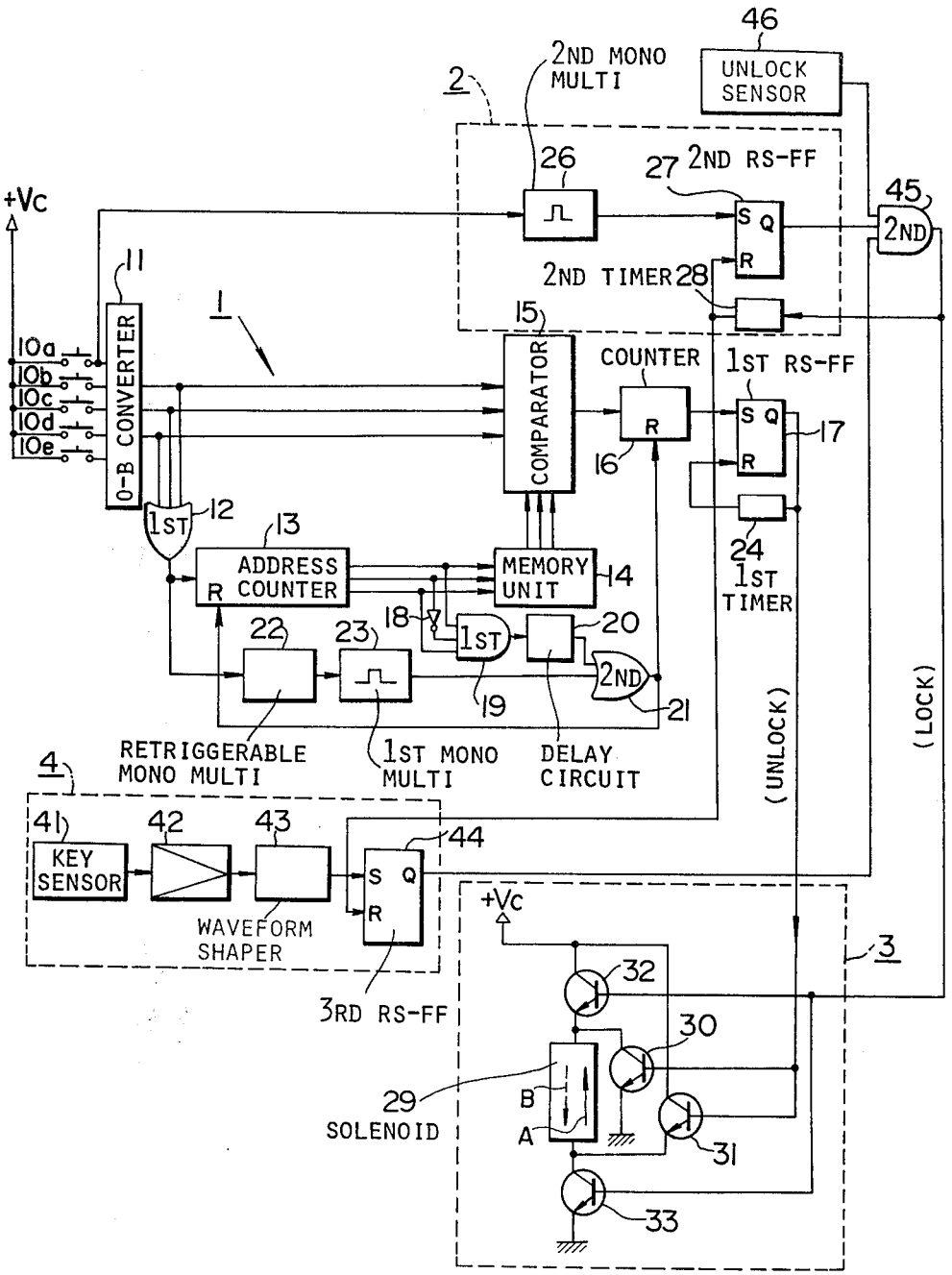
46
UNLOCK SENSOR
2ND MONO MULTI
2
26
27 2ND RS-FF
45
2ND
+Vc
11
2ND TIMER 28
1
15
10a
10b
10c
10d
10e
0-B CONVERTER
COMPARATOR
COUNTER
1ST RS-FF
17
16
1ST 12
13
ADDRESS COUNTER
MEMORY UNIT 14
24
1ST TIMER
18
1ST
20
22
23
2ND
19
21
RETRIGGERABLE MONO MULTI
1ST MONO MULTI
DELAY CIRCUIT
(UNLOCK)
(LOCK)
4
41
42
43
44
KEY SENSOR
WAVEFORM SHAPER
3RD RS-FF
+Vc
3
32
30
29
SOLENOID
B
A
31
33

ELECTRONIC DOOR LOCKING SYSTEM FOR AN AUTOMOTIVE VEHICLE

BACKGROUND OF THE INVENTION

1. Field of the Invention

The present invention relates generally to an electronic push-button type door locking device for an automotive vehicle, and more particularly to an electronic door locking system by which vehicle doors can be locked or unlocked when the driver depresses a single or a plurality of push-button type switches in accordance with a predetermined code.

2. Description of the Prior Art

The background of the present invention will be explained with respect to its application to the system used with an automotive vehicle.

As is well-known, there exists an electronic push-button type door locking system for an automotive vehicle, by which vehicle doors can be locked or unlocked when the driver depresses a single or a plurality of push-button type switches installed at an appropriate position on the outside of an automotive vehicle in accordance with a predetermined code. When such an electronic vehicle door locking system as described above is used to lock or unlock the doors, since the vehicle doors can be locked or unlocked by the driver without using the ignition key, it is very convenient for the driver, in particular, when the vehicle is left parked.

In the above-mentioned electronic door locking system, however, since the vehicle doors can be locked from the outside of the vehicle without use of the ignition key, when the driver parks his vehicle, there exists the possibility that he might leave his vehicle, after having locked the door by using the electronic push-button type door locking system, with the ignition key left inserted in the ignition keyhole.

In the case where the vehicle is left parked in the driver's own private parking space with the ignition key left in the ignition keyhole, there may be little chance of the vehicle's being stolen; however, in the case where the vehicle is left parked in public out of the driver's sight with the ignition key left in the ignition keyhole, since a thief can readily see whether or not the ignition key is left inserted in the ignition keyhole, there may be a chance that the thief will break the vehicle window to open the vehicle door even if the door is locked by the electronic push-button type door locking system, and may steal the vehicle by using the ignition key left in the keyhole.

SUMMARY OF THE INVENTION

With these problems in mind, therefore, it is the primary object of the present invention to provide an electronic door locking system for an automotive vehicle in which vehicle doors can be locked by depressing one of push-button switches only after the ignition key is removed from the ignition keyhole and next the removed ignition key is brought near a key sensor disposed near the push-button switches; that is, a door locking command signal is enabled only when the ignition is not left in the ignition keyhole.

Therefore, in the electronic door locking system according to the present invention, even if the driver depress one of the push-button switches, when the ignition key is in the ignition keyhole, the vehicle door cannot be locked, thus preventing the vehicle from being stolen when the vehicle is left parked with the ignition key left in the keyhole.

To achieve the above-mentioned object, the electronic door locking system for an automotive vehicle according to the present invention comprises, in particular, means for detecting the presence of an ignition key near the push-button switches and outputting a signal to enable a door locking command signal, in addition to the conventional electronic door locking system including a plurality of push-button switches, a octal-binary code converter, an address counter, a memory unit, comparators, a counter, reset-set flip-flops, etc.

BRIEF DESCRIPTION OF THE DRAWINGS

The features and advantages of the electronic door locking system for an automotive vehicle according to the present invention will be more clearly appreciated from the following description of the preferred embodiment of the invention taken in conjunction with the accompanying drawing in which;

The FIGURE is a schematic block diagram of an embodiment of the electronic door locking system according to the present invention.

DETAILED DESCRIPTION OF THE PREFERRED EMBODIMENTS

First, the circuit configuration of an embodiment of the electronic door locking system according to the present invention will be described hereinbelow with reference to the attached drawing.

The system according to the present invention can roughly be divided into four sections: a door unlocking command signal generating section 1, a door locking command signal generating section 2, a door lock/unlock actuating section 3, and an ignition key sensor section 4.

In the door unlocking command signal generating section 1, the reference numerals 10*a*–10*e* denote a plurality of push-button type switches arranged at an appropriate position on the outer surface of a vehicle door. To unlock vehicle doors, a specific sequence of numerals, such as the five digits "2-1-3-5-4" are used; while to lock the vehicle doors, a single specific numeral, such as the digit "2" (the first of the above five digits) is used. The reference numeral 11 denotes an octal-binary code converter (referred to as O-B converter hereinafter) for converting the octal code designated by the push-button switches 10*a*–10*e* into the corresponding three-bit binary code. The reference numeral 12 denotes a first OR gate for generating a H-voltage level output signal whenever the O-B converter 11 outputs a three-bit binary coded signal, and the reference numeral 13 denotes an address counter for generating an address-designating signal which is advanced incrementally by the H-voltage level signals from the OR gate 12.

In other words, when a first signal is inputted to the address counter 13 via the first OR gate 12, the counter 13 outputs a three-bit binary signal "001" to designate address No. 1 in the memory unit 14; when a second signal is inputted to the address counter 13 via the first OR gate 12, the counter 13 outputs a three-bit binary signal "010" to designate address No. 2 in the memory unit, and so on.

The reference numeral 14 denotes a memory unit such as a RAM or ROM in which the above-mentioned numerical code "2-1-3-5-4" is previously stored in the form of binary coded digits. The respective binary coded digits corresponding to the above-mentioned octal code "2-1-3-5-4" are read out sequentially in response to the address-designation signals outputted from the address counter 13. The reference numeral 15 denotes a comparator for comparing the binary coded digits outputted from the O-B converter 11 with the ones read out from the memory unit 14 and outputting a H-voltage level signal whenever the digits agree, the reference numeral 16 denotes a counter for outputting a signal after the comparator 15 has inputted the predetermined number of signals (five signals in this embodiment) consecutively thereto, and the reference numeral 17 denotes a first reset-set flip-flop (referred to as RS-FF hereinafter) for generating a door unlocking command signal when set by the output signal from the counter 16.

Further, the reference numeral 18 denotes an inverter, the reference numeral 19 denotes a first AND gate, the reference numeral 20 denotes a delay circuit, and the reference numeral 21 denotes a second OR gate. These elements serves to reset the counter 16 to a L-voltage level a fixed period of time after the predetermined octal unlocking code "2-1-3-5-4" has been inputted to the O-B converter 11 by the driver via the push-button switches 10*a*–10*e*.

In more details since the three-bit address signals from the address counter 13 are applied to the respective input terminals of the first AND gate 19, when the last digit of the octal unlocking code is inputted, the address counter 13 outputs a three-bit binary signal "101" (5 in octal code) to designate address No. 5 in the memory unit 14. Therefore, since this three-bit signal is inputted to the first AND gate 19 via the three independent input terminals, the first AND gate 19 outputs a H-voltage level signal, because "0" of the 2nd input terminal is applied to the first AND gate 19 after having been inverted into "1" through the inverter 18. This H-voltage level output signal from the first AND gate 19 is inputted to the delay circuit 20, and, after a fixed period has elapsed, the output signal from the delay circuit 20 resets the counter 16 through the second OR gate 21.

Furthermore, the reference numeral 22 denotes a retriggerable monostable multivibrator which can be retriggered when a H-voltage level signal is inputted thereto within a predetermined period of time but automatically reset to a L-voltage level when no H-voltage level signal is inputted thereto within a predetermined period of time. The reference numeral 23 denotes a first monostable multivibrator which is automatically reset to a L-voltage level after a H-voltage level is kept for a predetermined period of time when triggered. These elements serve to reset the counter 16 to a L-voltage level when the push-button switches are not depressed consecutively, that is, when the switches are depressed intermittently with delays exceeding a predetermined time interval. If the counter 16 is reset before outputting a signal, the first RS-FF 17 will not be set and so will not output a door unlocking signal. In more detail, the output signal from the first OR gate 12 is applied to the retriggerable monostable multivibrator 22 and the first monostable multivibrator 23 is so designed as to be triggered by the trailing edge of the output signal from the retriggerable monostable multivibrator 22. Therefore, in the case where the O-B converter 11 outputs binary coded signals consecutively to the trigger terminal of the retriggerable monostable multivibrator 22, the multivibrator 22 is repeatedly triggered to a H-voltage level without dropping to the L-voltage level as long as the binary coded signals are inputted, therefore, the first monostable multivibrator 23 is not triggered into a H-voltage level (because the first multivibrator 23 can be triggered only when the retriggerable multivibrator 22 changes to a L-voltage level), so that the counter 16 is not reset through the second OR gate 21. In the case where the O-B converter 11 outputs binary coded signals to the trigger terminal of the retriggerable monostable multivibrator 22 intermittently with delays exceeding a predetermined time interval (determined by setting a time constant of the CR circuit in the multivibrator 22), since the retriggerable monostable multivibrator 22 is automatically reset to a L-voltage level before the next binary coded signal from the first OR gate 12 triggers it, the trailing edge of the output signal therefrom triggers the first monostable multivibrator 23, and as a result the counter 16 is reset via the second OR gate 21 to the original condition before it can output a H-level signal to the first RS-FF 17.

Furthermore, after being set, the first RS-FF 17 for outputting a door unlocking signal is reset after a predetermined period of time by an output signal from a first timer 24 which starts in response to the H-voltage level output signal from the first RS-FF 17.

In the door locking command signal generating section 2, the reference numeral 26 denotes a second monostable multivibrator, and the reference numeral 27 denotes a second RS-FF.

To lock the vehicle doors, for instance, the second digit "1" of the five consecutive unlocking numerals "2-1-3-5-4" is depressed by the driver via one 10*a* of the push-button switches 10*a*–10*e*.

When the push-button switch 10*a* is depressed, a H-voltage level signal directly triggers the second monostable multivibrator 26. As a result, the second RS-FF 27 is set by the output signal from the second monostable multivibrator 26, in order to generate a door locking signal via a second AND gate 45 in the case where the gate 45 is open (explained later). After being set, the second RS-FF 27 for outputting a door locking signal is reset after a predetermined period of time by an output signal from a second timer 28 which starts in response to the H-voltage level output signal from the second RS-FF 27 where the gate 45 is open.

In the door lock/unlock actuating section 3, the reference numeral 29 denotes an actuator such as a solenoid or a motor and the reference numerals 30–33 denote transistors configuring a switching circuit.

The solenoid 29 is used for locking or unlocking the vehicle doors according to the direction of current flowing therethrough. In more detail, in the case where the first RS-FF 17 outputs a door unlocking command signal, since current is applied to the base of the first transistor 30, the first transistor 30 is turned on. In addition, since current is also applied to the base of the second transistor 31, the second transistor 31 is turned on so that a solenoid energizing current flows from the positive terminal +Vc, through the second transistor 31, the solenoid 29, and the first transistor 30 to ground in the direction of arrow A, so that the solenoid 29 is energized to unlock the vehicle doors. In the case where the second RS-FF 27 outputs a door locking command signal, since current is applied to the base of the fourth transistor 33, the fourth transistor 33 is turned on. In addition, since current is also applied to the base of the third transistor 32, the third transistor 32 is turned on so that a solenoid energizing current flows from the positive terminal +Vc, through the third transistor 32, the solenoid 29, and the fourth transistor 33 to ground in the direction of arrow B, so that the solenoid 29 is energized to lock the vehicle doors.

In the ignition key sensor section 4, the reference numeral 41 denotes a key sensor, the reference numeral 42 denotes an amplifier, the reference numeral 43 denotes a waveform shaper, the reference numeral 44 denotes a third RS-FF, and additionally the reference numeral 46 denotes an unlock sensor, the reference numeral 45 denotes the second AND gate.

The key sensor 41 is a magnetic head or a two-terminal type sensor for detecting the presence of a conductive material. An ignition key is usually made of iron or steel. To reduce the weight of the key recently the key is frequently made of brass being covered by nickel plating. In both the cases, the magnetic head can detect the presence of them. In more detail, in order to detect the presence of a metal, an AC bias voltage is applied to the magnetic head so as to generate an alternating magnetic field near the head. Therefore, when a conductive metal approaches the head, since the strength of the magnetic field changes due to the change in permeability, it is possible to detect the change in magnetic field as the change in induced voltage. This induced voltage change is amplified through the amplifier 42, and waveform-shaped through the waveform shaper 43.

This waveform shaper 43 is a circuit, such as a Schmitt trigger circuit, which can generate a rectangular pulse signal when the input voltage level rises beyond a predetermined level.

Since the output signal from the waveform shaper 43 is applied to the set terminal of the third RS-FF 44, the third RS-FF 44 is set when triggered by the output signal from the waveform shaper 43. Further, since the output terminal Q of the third RS-FF 44 is connected to one of the input terminals of the second AND gate 45, when the second and third RS-FFs are both set, the second AND gate 45 is open. Furthermore, the third RS-FF 44 is also reset by the output signal from the second timer 28 in the same way as in the second RS-FF 27.

The unlock sensor 46 is, for instance, a microswitch (not shown) installed near a door-locking bell-crank (not shown) and closed when a door is unlocked. However, it is possible to omit this unlock sensor 46, because when the door has already been locked, the push-button switches 10*a* may not be depressed by the driver to lock the door.

When the door is left unlocked, the unlock sensor 46 outputs a H-voltage level signal. When a driver correctly depresses one of the push-button switches 10*a*–10*e* to lock the door, a door locking command signal is outputted from the second RS-FF 27. Additionally, when a driver extracts an ignition key and brings it near the key sensor 41, the key sensor 41 also outputs a H-voltage level signal. Therefore, after amplified via the amplifier 42 and waveform shaped via the waveform shaper 43, this signal is applied to the set terminal of the third RS-FF 44. As a result, a H-voltage level signal from the third RS-FF 44 is applied to the second AND gate 45. Only when these three signals are applied to the input terminals of the second AND gate 45, a door locking command signal is applied to the door lock/unlock actuating section 3 to lock the door. In this embodiment, as is well understood, the order of depressing the push-button switches and bringing the ignition key near the key sensor 41 is not important.

The operation of the electronic door locking system for an automotive vehicle according to the present invention will be described hereinbelow.

In order to unlock the vehicle door, first a sequence of predetermined octal digits (2-1-3-5-4) are inputted by the driver via the switches 10*a*–10*e;* the O-B converter outputs a series of three-bit binary numbers (010-001-011-101-100) corresponding to the octal ones; whenever the O-B converter outputs a three-bit binary signal, the address counter 13 is advanced incrementally via the first OR gate 12 to output an address designation signal from No. 1 to No. 5, respectively; in response to these address-designation signals the memory unit 4 outputs the three-bit binary codes previously stored in the designated memory addresses; these numbers are compared with the one outputted from the O-B converter by the comparator 15; if the numbers match, the comparator 15 outputs a H-level signal; after a sequence of binary unlocking numbers have been successfully compared, the counter 16 outputs a signal to set the first RS-FF 17, so that a door unlocking signal is outputted.

Further, when the last unlocking number is inputted and therefore the address-designation signal No. 5 (101) is outputted from the address counter 13, the counter 16 is reset after a predetermined period of time determined by the delay circuit 20. If the unlocking numbers are inputted intermittently with delays exceeding a predetermined time interval, the counter 16 is also reset through the retriggerable monostable multivibrator 22 and the first monostable multivibrator 23.

In the case where the door is intended to be locked from outside the vehicle by depressing the appropriate push-button switch 10*a*–10*e* with the ignition key left inserted in the keyhole, the key sensor 41 outputs a L-voltage level signal indicative of the absence of the key near the key sensor 41, and thereby the RS-FF 44 is not set. Therefore, no H-voltage level signal is applied to one of the input terminals of the second AND gate 45. As a result, even if the proper push-button switch 10*a* is depressed to lock the door, no locking signal will be outputted via the second AND gate 45, door lock operation being disabled.

Accordingly, the driver will notice that the ignition key is in the keyhole. If the key is removed and brought near the key sensor 41, the key sensor 41 outputs a H-voltage level signal to set the RS-FF 44.

Under these conditions, when the proper push-button swtich 10*a* is depressed, a H-voltage level signal directly triggers the second monostable multivibrator 26; a locking signal is outputted when the second RS-FF 27 is set. The transistors 32 and 33 are turned on in response to the locking signal, and current passes through the solenoid 29 in the direction of arrow B to lock the vehicle door.

As described above, in the electronic door locking system according to the present invention, since the door locking command signal is automatically disenabled when the ignition key is in the keyhole, the driver must remove the ignition key from the keyhole and bring it near the key sensor 41 in order to lock his vehicle, with the result that it is possible to securely prevent the vehicle from being stolen.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A door locking system for an automotive vehicle for locking vehicle doors, which comprises:

(a) means for generating a door-locking signal;

(b) means for detecting the presence of an ignition key brought near said means for generating a door-locking signal and outputting a signal corresponding thereto;

(c) an AND gate one input terminal of which is connected to said means for generating a door-locking signal and the other input terminal of which is connected to said means for detecting the presence of an ignition key; and (d) a door locking actuator connected to the output terminal of said AND gate for locking the vehicle doors when said means for generating a door-locking signal and said means for detecting the presence of an ignition key both output the respective output signals at the same time.

2. An electronic door locking system for an automotive vehicle for locking vehicle doors which comprises:

(a) means for inputting a sequence of unlocking coded numbers and at least one locking coded number and outputting signals corresponding thereto;

(b) means for generating an unlock command signal in response to a sequence of unlocking coded numbers outputted from said means for inputting coded numbers;

(c) means for generating a lock command signal in response to at least one locking coded number outputted from said means for inputing coded numbers;

(d) an AND gate one input terminal of which is connected to said means for generating a lock command signal;

(e) means for locking/unlocking the vehicle doors connected to said means for generating an unlock command signal for unlocking the vehicle doors in response to the unlock command signal outputted from said means for generating an unlock command signal and connected to the output terminal of said AND gate for locking the vehicle doors;

(f) means for detecting the presence of the ignition key the output terminal of which is connected to the other input terminal of said AND gate, for outputting a signal to said AND gate to pass the door locking command signal outputted from said means for generating a lock command signal to said means for locking/unlocking the vehicle doors, whereby the vehicle doors can be locked when at least one predetermined door-locking coded number is inputted to the system and when the ignition key is extracted from the ignition keyhole and brought near the means for detecting the presence of the ignition key.

3. An electronic door locking system for an automotive vehicle for locking vehicle doors which comprises:

(a) a plurality of switches for outputting at least one predetermined door-locking signal and a sequence of predetermined door-unlocking octal coded digit signals;

(b) a octal-binary code converter connected to a plurality of said switches for converting the octal coded digits inputted from said switches into the corresponding binary coded digits;

(c) an address counter connected to said octal-binary code converter for counting up a plurality of the binary-coded signals outputted from said octal-binary code converter whenever one of said switches is depressed and outputting an address-designation signal in response to the number of signals outputted from said octal-binary code converter;

(d) a memory unit connected to said address counter for outputting a previously stored binary coded signal in response to the address-designation signal outputted from said address counter;

(e) a comparator connected to said octal-binary code converter and said memory unit for outputting a signal when one of the binary coded door-unlocking signals outputted from said octal-binary code converter agrees with one of the binary coded door-unlocking signals outputted from said memory unit in response to the respective address-designation signal outputted from said address counter;

(f) a counter connected to said comparator for outputting a signal when said comparator outputs the predetermined number of binary coded signals;

(g) a first reset-set flip-flop connected to said counter for outputting a door unlocking command signal when said first counter outputs the signal;

(h) a second reset-set flip-flop connected to at least one of said switches for outputting a door locking command signal when said switch is depressed;

(i) an AND gate one input terminal of which is connected to said second reset-set flip-flop;

(j) a door lock/unlock actuating solenoid connected to said first reset-set flip-flop for unlocking the vehicle doors when said first reset-set flip-flop is set and connected to the output terminal of said AND gate;

(k) means for detecting the presence of the ignition key and outputting a signal corresponding thereto, the output terminal of which is connected to the other input terminal of said AND gate, said means outputting a signal to said AND gate to pass the door locking command signal outputted from said second reset-set flip-flop to said door lock/unlock actuating solenoid, whereby the vehicle doors can be locked when at least one predetermined door-locking signal is inputted to the system and when the ignition key is extracted from the ignition keyhole and brought near the means for detecting the presence of the ignition key.

4. An electronic door locking system for an automotive vehicle for locking vehicle doors as set forth in any one of claims 1, 2, or 3, wherein said means for detecting the presence of the ignition key comprises:

(a) a key sensor for detecting the presence of the ignition key and outputting a signal corresponding thereto;

(b) a waveform shaper connected to said key sensor for waveform-shaping the signal outputted from said key sensor into a rectangular waveform pulse signal; and (c) an RS-FF connected to said waveform shaper for outputting a signal to the other input terminal of said AND gate when set by the signal outputted from said waveform shaper.

5. An electronic door locking system for an automotive vehicle for locking vehicle doors as set forth in claim 4, wherein said key sensor is a magnetic head.

6. An electronic door locking system for an automotive vehicle for locking vehicle doors as set forth in claim 4, wherein said waveform shaper is a Schmitt circuit.

7. An electronic door locking system for an automotive vehicle for locking vehicle doors as set forth in any one of claims 1, 2, or 3, which further comprises an unlock sensor connected to another input terminal of said AND gate for outputting a signal only when the vehicle doors is in an unlock state.

* * * * *